US005150767A

United States Patent [19]

Miller

[11] Patent Number: 5,150,767

[45] Date of Patent: Sep. 29, 1992

[54] PORTABLE SELF-CONTAINED IMPACT SYSTEM

[75] Inventor: Ralph A. Miller, Monmouth Beach, N.J.

[73] Assignee: Air Cruisers, Inc., Belmar, N.J.

[21] Appl. No.: 656,731

[22] Filed: Feb. 19, 1991

[51] Int. Cl.[5] ..... A62B 5/00

[52] U.S. Cl. ..... 182/137; 182/48

[58] Field of Search ..... 182/137, 48, 138, 139; 5/453, 455, 456; 441/42, 40

[56] References Cited

U.S. PATENT DOCUMENTS

| | | | |
|---|---|---|---|
| 1,985,432 | 12/1934 | Tucker et al. | 182/137 X |
| 2,390,955 | 12/1945 | McDonnell | 182/137 |
| 2,906,366 | 9/1959 | Mapes | 182/139 |
| 2,968,820 | 1/1961 | Pritty | 441/42 |
| 3,310,818 | 3/1967 | Fischer | 5/420 |
| 3,391,414 | 7/1968 | Gordon | 182/139 X |
| 3,399,407 | 9/1968 | Olsen | 182/139 X |
| 3,458,009 | 7/1969 | Favors | 182/48 |
| 3,747,952 | 7/1973 | Graebe | 5/456 X |
| 3,851,730 | 12/1974 | Scurlock | 182/137 |
| 4,280,239 | 7/1981 | Brown | 441/42 |
| 4,375,877 | 3/1983 | Shorey | 182/48 X |
| 4,644,597 | 2/1987 | Walker | 5/455 X |
| 4,875,548 | 10/1989 | Lorsbach | 182/137 |
| 5,060,753 | 10/1991 | Hopkins | 182/48 |

FOREIGN PATENT DOCUMENTS

| | | | |
|---|---|---|---|
| 1122826 | 8/1968 | United Kingdom | 441/42 |

*Primary Examiner*—Karen J. Chotkowski

*Attorney, Agent, or Firm*—Anthony F. Cuoco

[57] ABSTRACT

An impact system features an integral stored gas inflation source augmented by an ejector which entrains ambient air to rapidly deploy an inflate a safety cushion. The cushion has a plurality of chambers and each chamber is interconnected to an adjacent chamber by valves connected in opposing directions. When a particular cushion chamber is impacted, gas in the impacted chamber is forced via the valve arrangement into an adjacent lower pressure chamber. Upon the impacting object being removed from the cushion, the valve arrangement permits a reverse flow of gas to equilibrate the pressure in the adjacent chambers whereby the system is ready for accepting a subsequent impact without the need for reinflating the cushion. The system is of a size and weight so as to be within the limits of portability by a minimum of using personnel without being otherwise assisted.

13 Claims, 1 Drawing Sheet

PORTABLE SELF-CONTAINED IMPACT SYSTEM

BACKGROUND OF THE INVENTION

This invention relates to an impact system for use, for example, in evacuation of occupants from burning buildings and the like. More particularly, this invention relates to a system for the purposes described including an inflatable member for safely breaking the fall of a person jumping from the building to escape therefrom.

Emergency escape of evacuees from multi-story buildings which are burning or subject to a like hazard so as to prohibit ordinary egress from the building has heretofore been accomplished by means such as extension ladders, hand-held safety nets, chutes, fire escapes and inflatable cushions. With the exception of the safety net, the aforementioned emergency escape devices are constrained in their utility by limited portability. Even a safety net, while fairly portable, requires the involvement of skilled, trained personnel. In regard to impact systems using inflatable cushions, the prior art systems have limited portability due to the need for a power driven inflation source for initial deployment and replenishment of air vented upon impact to soften said impact. In the prior art devices, an electric motor driven blower is typically used as the inflation source, and as the makeup gas supply for gas that is vented to the atmosphere through relief valves for dissipating impact energy. In an arrangement of this type, not only is portability sacrificed, but the capability to rapidly accept evacuees is restricted by the need to reinflate the system to its operating pressure each time impact is achieved so that it will be ready for the next evacuee.

The present inventor is aware of the following prior art relating generally to the subject matter of the invention: U.S. Pat. No. 2,390,955 (Dec. 11, 1945); U.S. Pat. 2,797,853 (Jul. 2, 1957); U.S. Pat. No. 2,906,366 (Sep. 29, 1959); U.S. Pat. No. 3,310,818 (Mar. 28, 1967); U.S. Pat. No. 3,391,414 (Jul. 9, 1968); U.S. Pat. No. 3,399,407 (Sep. 3, 1968); U.S. Pat. No. 3,840,922 (Oct. 15, 1974); and U.S. Pat. No. 3,851,730 (Dec. 3, 1974).

U.S. Pat. No. 2,390,955 relates to a fire escape system including an inflatable bag that can be quickly expanded or inflated by use of a high volume of low pressure air such as may be available from standard fire equipment. The requirement for auxiliary equipment restricts the use of the patented system.

U.S. Pat. No. 2,797,853 relates to an inflatable safety bag or the like wherein the compressed air that fills the bag and absorbs the impact energy is allowed to escape through relief valves so as to avoid the tendency to resist the force of the falling body causing the body to be thrown from the bag with possible resultant injury. In an arrangement of this type, the bag must be reinflated for subsequent use and hence cannot rapidly accept evacuees or the like.

U.S. Pat. No. 2,906,366 is directed to an inflatable member including an arrangement for gradually absorbing the impact of a body landing on the bag and thus relates to a different structural arrangement than that of the present invention.

U.S. Pat. No. 3,310,818 relates to an inflatable shock absorbing mat including a plurality of superimposed inflatable chambers and a plurality of manifolds around the sides of said chambers. An object impacting the top of the mat forces air from the superimposed chambers through air passages into the manifolds, and then through exhaust valve outlet means to the atmosphere whereby the constriction of air flow through said air passages provides a shock absorbing effect for a falling object impacting the mat. Here again, reinflation of the apparatus is necessary for successive impact situations which limits the use of the arrangement.

U.S. Pat. No. 3,391,414 relates to a pneumatic landing pit cushion constructed so as to embody a relatively stiff though yieldable rim portion and a softer more highly yieldable central cushioning portion, thereby tending to deflect a body upon impact inwardly into the cushioning area, rather than outwardly over the periphery of the cushion in the event of a landing near the periphery. The arrangement tends to minimize the likelihood of injury resulting from deflection of the cushion unto the hard supporting surface surrounding the cushion. The patented device relates to a different structural arrangement than that of the invention disclosed herein.

U.S. Pat. No. 3,399,407 relates to a cushion for decelerating falling bodies and features a closed flexible bag having a conduit communicating with the bag and a continuously operating fan unit in the conduit for creating artificial currents of air to maintain the pressure in the bag at a predetermined level. Air expelled from the bag upon impact of a falling object flows in a reverse direction through the fan unit to avoid pressure buildup sufficient to damage the object. This invention requires an independent fan unit for inflation purposes, the same being advantageously avoided by the arrangement of the invention herein disclosed.

U.S. Pat. No. 3,840,922 relates to a landing cushion for falling objects featuring a relatively high pressure cushion in advance of a lower pressure cushion to widen the impact area of the falling object on the lower pressure cushion, thus distributing the force of the object over a larger area and allowing the decelerating inflation pressure to be relatively low at the moment of impact. This is seen to be a different structural arrangement than that of the invention herein disclosed.

U.S. Pat. No. 3,851,730 teaches an inflatable safety cushion wherein an inflatable section defines a generally closed air system and an air breather system is located in said section for allowing air to be rapidly exhausted from the interior of said section upon impact of a body falling thereon. The breather system is arranged to allow quick but controlled release of built-up air pressure upon impact of an object. With an arrangement of the type described the safety cushion is not readily available for subsequent impact situations as is the present invention.

SUMMARY OF THE INVENTION

This invention contemplates a portable self-contained impact system featuring a light weight high pressure stored gas inflation source augmented by an ejector which entrains ambient air to rapidly deploy and inflate a cushion which is part of the system. The cushion is a closed inflatable member having a plurality of interconnected chambers whereby no overboard venting of inflating gas during use is required. Impact energy is dissipated by interconnecting the chambers via flow restricting valves arranged to permit gas flow in opposing directions. When a falling object impacts the bag, gas in the impacted chamber is forced in one direction via associated flow restricting valve arrangements into adjacent lower pressure chambers. Subsequent to impact, after the impacting object is egressed from the cushion chamber pressures are equilibrated by flow through the valve arrangements in the opposite direction. The system is of a size and weight so as to be within the limits of portability by a minimum number of using personnel without assistance, and is self-contained in that it requires no external inflating source. The system has the capability to rapidly accept successive impacts since it is not constrained by the need to reinflate the cushion to its operating pressure.

DETAILED DESCRIPTION OF THE INVENTION

Figure 2:
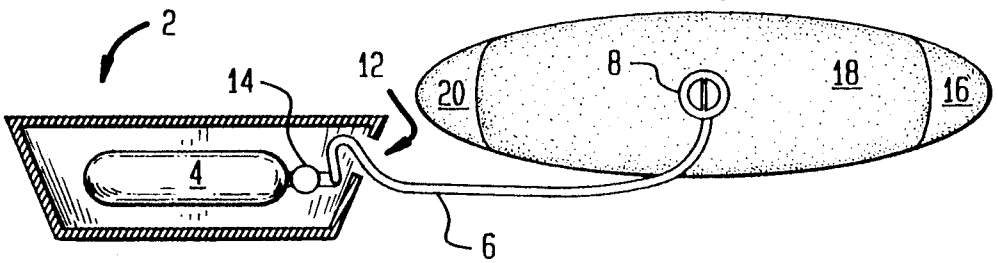
FIG. 2 is a partially sectioned diagrammatic representation illustrating the invention in a deployed mode.
Figure 1:
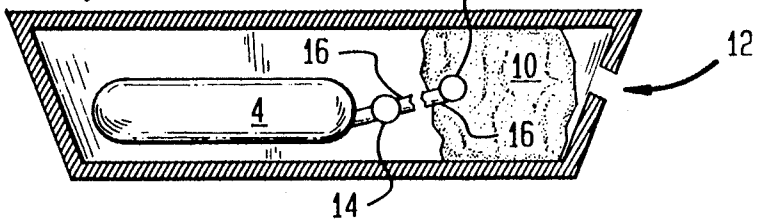
FIG. 1 is a partially sectioned diagrammatic representation illustrating the invention in an undeployed mode.

With reference first to FIGS. 1 and 2, the disclosed system is shown as including a hard container 2. Container 2 houses a normally closed reservoir 4 which is charged with a suitable supply of gas such as nitrogen under a high pressure. Reservoir 4 is connected to an inflation hose 6 which, in turn, is connected to an ejector 8 coupled to an inflatable member or cushion 10 which is within container 2 when undeployed. Hard container 2 has an egress 12.

With particular reference to FIG. 2 when gas reservoir 4 is opened, via a valve or the like 14 which is accessible to a user as through the side of the container, gas flows through hose 6, whereupon the flow of the gas is augmented by ejector 8 which entrains ambient air to rapidly deploy inflatable cushion 10 and at least part of hose 6 out of hard container 2 through egress 12, and to inflate the cushion as illustrated in the figure.

Figure 3:
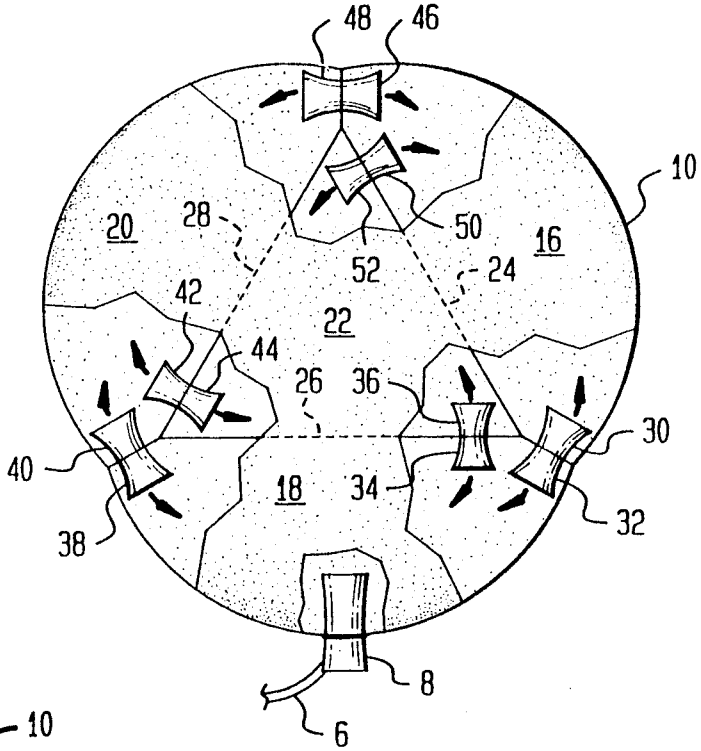
FIG. 3 is a partially cut-away diagrammatic representation illustrating a compartmentalized inflated cushion according to the invention, and further illustrating valve means whereby the several chambers communicate with adjacent chambers so as to permit gas flow in opposing directions.

With particular reference to FIG. 3, inflatable cushion 10 is a closed inflatable member having a plurality of interconnected chambers. With the arrangement to be herein described, there is no overboard venting of the inflating gas during use of the system as will be recognized as advantageous.

Inflatable cushion 10 is shown as having, for purposes of illustration, four adjacent chambers designated by the numerals 16, 18, 20 and 22, wherein chamber 22 is a substantially central chamber. Inflatable cushion 10 is constructed of a suitable gas impermeable material and the several chambers 16–22 are separated by taut, likewise gas impermeable bulkhead - like members 24, 26 and 28, when cushion 10 is inflated.

Adjacent chambers 16, 18, 20 and 22 are interconnected by, for example, metered (variable area) flexible "duckbill" fabric relief valves, the same being well known in the art. Thus, and with continued reference to FIG. 3, valves 30 and 32 are arranged in opposing directions and interconnect chambers 16 and 18; valves 34 and 36 are arranged in opposing directions and interconnect chambers 18 and 22; valves 38 and 40 are connected in opposing directions and interconnect chambers 18 and 20; valves 42 and 44 are arranged in opposing directions and interconnect chambers 20 and 22; valves 46 and 48 are arranged in opposing directions and interconnect chambers 16 and 20; and valves 50 and 52 are arranged in opposing directions and interconnect chambers 16 and 22.

With the arrangement described impact energy is dissipated by the interconnection of the chambers via the aforementioned valves. When an object, such as an evacuee from a burning building or the like, impacts cushion 10, gas in the particular chamber 16, 18, 20 or 22, which is impacted, is forced via an appropriate valve into adjacent, lower pressure chambers. Subsequent to impact, and after the evacuee egresses cushion 10, the pressure in the adjacent chambers equilibrates by back flow through appropriated valves, said valves being arranged in opposing directions as aforenoted. This feature of the invention is illustrated by the arrows in FIG. 3.

It will now be realized that when the need to use the invention has ended i.e. after extensive use during a fire or like emergency in a high-rise building, cushion 10 is deflated as by disconnecting hose 6 from reservoir 4, and thereafter recharging the reservoir and storing hose 6 and deflated cushion 10 in container 2; whereupon the invention is ready for another emergency use.

It will be recognized that the system described is a self-contained system which requires no outside energy i.e. inflating source. The capability to rapidly accept successive evacuees, i.e. the evacuee acceptance into, is enhanced since there is no need to reinflate cushion 10 after initial or subsequent impacts. In this connection, it will be recognized that the prior art devices require means to "soften" the impact of an evacuee on a safety cushion to prevent the evacuee from being thrown from the cushion and to possibly suffer injury. The prior art devices accomplish this by evacuating the inflatable member to the atmosphere, and thus inhibit the rate at which evacuees are accepted. It will be recognized that the present invention overcomes this particular disadvantage through the interconnection of the several chambers by valves arranged in opposing directions as heretofore described.

An important feature of the invention is that it is extremely portable, which enhances its use in emergency situations as will be readily recognized. To this extent, and in a preferred embodiment of the invention, the weight and size of all of the components within the container for an inflated cushion having an approximate impact area of fifteen feet by fifteen feet and an approximate depth of two and one-half feet has been found to be well within the accepted limits of portability by a minimum, i.e. two, using personnel without being otherwise assisted.

With the above description of the invention in mind reference is made to the claims appended hereto for a definition of the scope of the invention.

What is claimed is:

1. A portable self-contained impact system, comprising:

a container having an egress;

an initially closed reservoir charged with an inflating gas stored at a high pressure in the container and including a user-accessible valve which is user-actuable for opening said reservoir;

an initially deflated inflatable member stored in the container and including a plurality of adjacent sections having a substantially central section;

means initially stored in the container for coupling the reservoir to the inflatable member;

the container having the gas charged reservoir, the deflated inflatable member and the coupling means stored therein being of a size and weight so as to be portable by a minimum of using personnel without being otherwise assisted;

the reservoir valve being user-actuated for opening the reservoir, whereby the gas at a high pressure in the reservoir flows through the coupling means to force at least part of said coupling means and the inflatable member out of the container through the egress, and to inflate said inflatable member; and the inflated member being arranged so that an impacting force on sections of the member causes the inflating gas in said impacted sections to be at a high pressure and to be forced into adjacent non-impacted sections of the member wherein the inflating gas is at a lower pressure, and the gas pressure in the member sections being equilibrated when the impacting force is removed, whereby the member is a closed inflatable member which avoids venting the inflating gas to soften an impact causing the impacting force.

2. A system as described by claim 1, wherein:

a plurality of valve means are arranged with the member sections so that each of said valve means interconnects one of the sections with an adjacent section;

each of said valve means including a first valve member for permitting gas flow between the interconnected sections in one direction and a second valve member for permitting gas flow between said interconnected sections in the opposite direction; and the impacting force on impacted sections of the inflated member causing gas to flow through the first valve members from the high gas pressure impacted sections to adjacent lower gas pressure non-impacted sections, and the removal of the impacting force from the impacted sections causing gas to flow through the second valve members to equilibrate the gas pressure in the sections.

3. A system as described by claim 1, wherein the means initially stored in the container for coupling the reservoir to the inflatable member includes:

a hose coupled at one of its ends to the reservoir;

an ejector which entrains ambient air coupled to the inflatable member and coupled to the other end of the hose; and gas flowing through the hose when the valve is opened, with said gas flow augmented by the ejector, to force at least part of the hose and the inflatable member and the ejector coupled thereto out of the container through the egress, and to inflate said inflatable member.

4. A portable self-contained impact system, comprising:

a closed reservoir for storing an inflating gas at a high pressure, and including a valve which is user-actuable for opening the reservoir;

an inflatable member including a plurality of adjacent chambers having a substantially central chamber;

a plurality of valve means interconnecting said plurality of adjacent chambers;

a hose and an ejector which entrains ambient air coupled to the reservoir and to the inflatable member, said hose and ejector effective for permitting gas flow from the reservoir to the inflatable member and through the plurality of valve means to inflate the plurality of adjacent chambers when the valve is user-actuated for opening the reservoir; and the inflatable member being a closed member so as to avoid venting of the inflating gas when said member is impacted, with impacting energy being dissipated when gas flows through the plurality of valve means from impacted chambers at a high gas pressure to adjacent non-impacted chambers at a low gas pressure.

5. A system as described by claim 4, wherein each of the plurality of valve means includes:

a first valve member for permitting gas flow between interconnected chambers in one direction and a second valve member for permitting gas flow between said interconnected chambers in the opposite direction; and the impacting energy being dissipated when gas flows through the first valve members from the impacted high pressure chamber to adjacent low pressure chambers, with the pressures in the chambers being equilibrated when gas flows through the second valve members upon removal of an impaction.

6. A system as described by claim 4, including:

a container having an egress and storing the reservoir, the hose and ejector and the inflatable member when the system is undeployed; and at least part of the hose, the ejector and the inflatable member being forced out of the container through the egress, and the inflatable member chambers being inflated, when the system is deployed upon actuating the valve for opening the reservoir.

7. A system as described by claim 6, wherein:

the container having the reservoir, the hose and ejector and the inflatable member stored therein is of a size and weight so as to be transportable by a minimum of using personnel without being otherwise assisted.

8. A portable self-contained impact system, comprising:

a closed reservoir for storing an inflating gas at a high pressure, and including a user-actuable valve for opening the reservoir;

an inflatable member including a plurality of adjacent sections having a substantially central section;

a plurality of valve means interconnecting said plurality of adjacent sections;

coupling means for coupling the reservoir to the inflatable member, said coupling means being effective for permitting gas flow therethrough from the reservoir to the inflatable member to inflate said member when the valve is actuated for opening the reservoir; and the inflatable member being a closed member and arranged so as to avoid venting of the inflating gas when said member is impacted, with impacting energy being dissipated when gas flows through the plurality of valve means from impacted high pressure member sections to adjacent non-impacted low pressure member sections.

9. A system as described by claim 8, wherein:

a plurality of valve means are arranged for interconnecting said plurality of sections; and the gas flowing through the coupling means from the reservoir to the inflatable member flows through the plurality of valve means to inflate the plurality of sections.

10. A system as described by claim 9, wherein each of the plurality of valve means includes:

a first valve member for permitting gas flow between interconnected sections in one direction to inflate the plurality of sections, and a second valve member for permitting gas flow between interconnected sections in the opposite direction; and the impacting energy being dissipated when gas flows through the second valve member from impacted high pressure sections to adjacent non-impacted low pressure member sections, with the pressures in the sections being thereupon equilibrated.

11. A system as described by claim 8, including:

a container having an egress and storing the reservoir, the coupling means and the inflatable member when the system is undeployed; and at least part of the coupling means and the inflatable member being forced out of the container through the egress, and the inflatable member sections being inflated, when the system is deployed upon the valve being user-actuated for opening the reservoir.

12. A system as described by claim 8, wherein the coupling means includes:

a hose coupled at one of its ends to the reservoir;

an ejector which entrains ambient air coupled to the inflatable member and coupled to the other end of the hose;

gas flowing through the hose when the valve is actuated to open the reservoir, with said gas flow augmented by the ejector, to force at least part of the hose and the inflatable member and the ejector coupled thereto out of the container through the egress, and to inflate the inflatable member sections.

13. A system as described by claim 11, wherein:

the container having the reservoir, the coupling means and the inflatable member stored therein is of a size and weight so as to be portable by a minimum of using personnel without being otherwise assisted.

* * * * *